US005482238A

United States Patent [19]

Kreiter

[11] Patent Number: 5,482,238

[45] Date of Patent: Jan. 9, 1996

[54] DISPLAY AND SUPPORT ASSEMBLIES

[76] Inventor: Donald E. Kreiter, 463 James Way, Wyckoff, N.J. 07481

[21] Appl. No.: 639,608

[22] Filed: Jan. 10, 1991

Related U.S. Application Data

[63] Continuation of Ser. No. 257,494, Oct. 13, 1988, abandoned.

[51] Int. Cl.[6] ..... A47F 5/00

[52] U.S. Cl. ..... 248/222.12; 248/345.1; 211/183

[58] Field of Search ..... 248/221.4, 243, 248/241, 223.4, 345.1, 219.4; 211/183, 193, 153, 187

[56] References Cited

U.S. PATENT DOCUMENTS

| | | | |
|---|---|---|---|
| 1,229,765 | 6/1917 | Lehman | 52/718.8 X |
| 1,852,833 | 4/1932 | Borsky et al. | 52/718.1 |
| 2,564,386 | 8/1951 | Webb | 52/716 X |
| 4,065,904 | 1/1978 | Taylor et al. | 211/193 |
| 4,585,131 | 4/1986 | Crossman et al. | 211/183 X |
| 4,587,774 | 5/1986 | Wendt | 248/243 X |
| 4,711,420 | 12/1987 | Cowler et al. | 248/243 |

FOREIGN PATENT DOCUMENTS

| | | | |
|---|---|---|---|
| 0020842 | 1/1981 | France . | |
| 2189138 | 10/1987 | United Kingdom | 248/243 |

OTHER PUBLICATIONS

Jade Options Brochure, Pam International Company, Inc., p. 18 (submitted by applicant as prior art in Ser. No. 257,494—parent appl.).

*Primary Examiner*—Karen J. Chotkowski

*Attorney, Agent, or Firm*—Dickie, McCamey & Chilcote; Leland P. Schermer

[57] ABSTRACT

Improved display and support assemblies which can be used in commercial establishments to display goods directly or to support other hardware for displaying goods, and which can be used in homes and offices to support personal items in a holding or storage capacity. The basic support member can be free-standing or joined to a wall. The support member can be covered by post covers of varying shapes to create overall visual looks or appearances, where the post covers are snapped onto and off of the support member for quick and easy changing of colors, shapes or appearances. The support member can have spaced apertures running along its length or it can be extruded and have a groove running along its length into which inserts having spaced apertures may be placed. Display hardware is attached to the support member by insertion into the apertures. The support member can be joined to a wall for further support in a way that permits controlled movement of the support member along a track attached to the wall. The support member attaches to a post mount, part of which resides within a channel of the track.

3 Claims, 11 Drawing Sheets

DISPLAY AND SUPPORT ASSEMBLIES

This is a continuation, of application Ser. No. 07/257,494 filed Oct. 13, 1988 now abandoned.

BACKGROUND OF THE INVENTION

This invention pertains to the field of display and support fixtures. In particular, it relates to improved display and support assembly designs used to mount and display goods in a commercial establishment, or to mount and carry items in closets and the like in one's home.

While there are many display and support assemblies, fixtures and related hardware on the market, I have discovered many ways to improve the versatility and ease with which one can use display and support fixtures.

Some of the inventions of the present application are improvements over a display post assembly found in the prior art. Display post assemblies manufactured and sold by Jade Interior Ltd. Retail Merchandising & Display Systems of Great Britain ("Jade") have been in use and on sale for several years in the United States and abroad.

A Jade display post assembly is the subject of a British patent application No. 2,189,138, filed Apr. 17, 1986. The British application describes a display post similar to the commercial product which Jade manufactures and sells both in the United States and abroad. These display post assemblies are useful to commercial establishments seeking to create a certain visual "look" or "theme." The display post assemblies include post covers whose main function is to create the desired look in connection with merchandise display.

SUMMARY OF THE INVENTION

The present inventions are directed to improved display and support assemblies which permit simple construction, use, movement, and alterations of the assembly. In particular, the removal and replacement of post covers, the design of the support member of an assembly, the means for moving and securing the assemblies, and the ability to use hardware that meets the industry standards in the United States are improvements of the inventions disclosed herein. The present inventions include a means for slidably attaching posts or support members to a wall. The present inventions also include a display post assembly having post covers that snap onto the posts or support members of the assembly.

In the field of merchandise display, the prior art Jade display post assembly lacks versatility in mounting and in changing the display post covers. The display post covers of Jade cannot be attached or disengaged as easily as desired. As a result, changing the appearance of a Jade display post assembly is not particularly convenient. In addition, many United States manufacturers of display fixtures have different needs and specifications than European manufacturers of display fixtures, in part because the metric system and non-standard spaced apertures are the basis for the design parameters in Europe and not in the United States.

The display assembly of the present invention includes a support member (or display post). The typical support member is generally rectangular or square in shape and generally hollow, although it could be other shapes and configurations consistent with the overall objectives of the inventions described and claimed herein.

One embodiment of the present invention comprises a generally hollow extruded support member having a center brace design and internal grooves running the length of the support member. Inserts having spaced apertures are placed in the grooves to provide further structural support and a means for attaching display hardware to the support member. The grooves have at least one side that is unobstructed so as to permit insertion of display hardware. The extruded support member includes an exterior surface over which display post covers can snapably attach.

Another embodiment of the present invention has snap-on edges in two locations along the length of the opposite shorter sides of a generally rectangular shaped support member or on opposite sides of a generally square-shaped support member. The snap-on edges are found on both sides of a series of spaced apertures also running along the length of the support member. The support member has at least one series spaced apertures along its length, and typically has two such sets of spaced apertures on opposite sides.

Yet another embodiment of the present invention uses a means for snapably attaching post covers, said means being joined to a support member by any conventional means for joining two articles, such as screws or rivets.

The display assemblies may include at least one post cover. It can also be used without a post cover, or it can have two or more post covers, depending upon style or appearance considerations, or upon the shape of the support member. When post covers are used, they are removably snapped onto the support member directly (having snap-on edges) or onto the means for snapably attaching post covers that is joined to the support member. The post covers can cover the post sides, but they should leave exposed the spaced apertures.

The post covers are primarily ornamental and provide visual "looks" more than a particular function. The post covers usually overlay the sides of the support member not having spaced apertures. The post covers can also wrap around part of the side of the support member having apertures to cover only a portion of this side while leaving the spaced apertures unobstructed. The spaced apertures are for inserting display hardware, such as "arms", which either carry merchandise in the case of a commercial application, or which support a shelf or other piece of equipment for home or commercial use. The post covers snap onto the support member by communicating generally at their interior edges with the snap-on edges, or by communicating interiorly with a means for snapably attaching post covers joined to the support member. The present inventions find a primary improvement in this snap-on feature of the post covers to the support members.

The prior art British patent application No. 2,189,138 discloses the Jade display post assembly upon which one of the present inventions is an improvement. A drawback to the Jade display posts resides in the means for securing its cover member onto the elongated support member, as shown in FIG. 2 of application No. 2,189,138. At lines 53–98, preferred and alternative embodiments of the Jade display post are disclosed. The Jade display assembly includes "at least one fastener in the form of a spring clip." Moreover, in the Jade display post design disclosed in British patent application No. 2,189,138, "the cover member may be hollow and each said spring clip may pass through and secure an inner wall of the cover member to bear against the inner wall on an inner surface thereof and thus secure the cover member snuggly to the support member against a wider side and a part of each narrower side. A spring clip may be attached to the cover member or to the support member prior to assembly thereof." (lines 69–78).

The utilization of fasteners or spring clips in the manner taught by the Jade British patent application and as practiced by Jade's commercial product limits the versatility of the entire display post assembly. The limitation operates to require time-consuming disassembly of display posts when it becomes desirable to change only the display post covers. The covers are desirably changeable to allow for variations in color, shape and overall appearance. Once the fastener or spring clip in the Jade design is attached to the hollow, elongated support member, in order to change the display post cover one must disassemble the configuration of display posts and slide the cover along the entire length of each support member until the fastener disengages the cover.

Since it is contemplated that a configuration of display posts of the Jade British application could be a structure used to display goods or the like in commercial establishments, and such a structure may be erected in a mann, that could require extensive disassembly to change the covers and, hence, the appearance, it is clearly desirable to have an improved way in which to attach the cover member to the support member than that provided in the Jade British patent application or by the Jade commercial products.

In the present invention, the post covers are designed to snap onto the elongated support members or onto a means for snapably attaching post covers without having to slide its entire length over a spring clip or other fastener in the Jade design. This improvement makes changing the post covers fast and easy. The need to slide the covers over a spring clip or other fastener as in the Jade design requires disassembly each time a change in covers is desired. This problem can be acute, for example, when the Jade display post assembly is used to create a large multi-post structure that abuts a wall or a ceiling in a commercial establishment. Thus it is an object of the present invention to overcome this design shortcoming in the Jade display post assembly that limits the versatility of the Jade design. To achieve this object, the post covers and the support member are designed to have mutually communicating portions that allow for snapably attaching the cover to the support member as described in detail hereafter.

Additionally, the commercial Jade display assembly does not itself provide a convenient way to connect the support member to a wall to obtain added support and the ability to move the assembly, in a controlled manner, along the wall. It is a further object of some of the inventions disclosed and claimed herein to provide increased support for the assembly, as well as increased mobility once assembled (without disassembly).

DESCRIPTION OF THE PREFERRED EMBODIMENTS

The present inventions can be readily understood with reference to the drawings provided herewith.

Figure 1A:
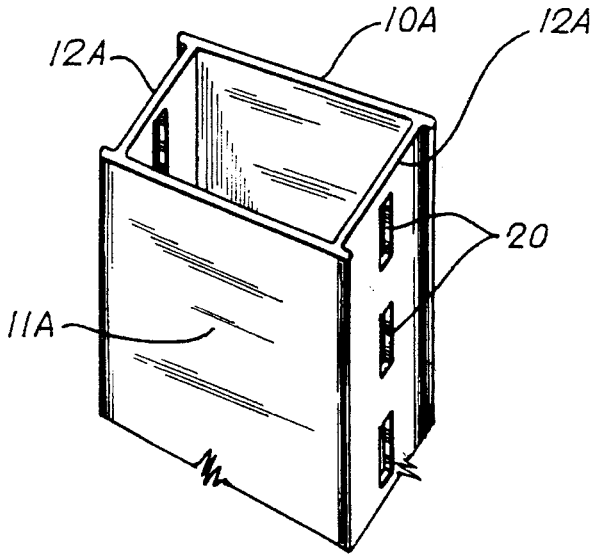
FIG. 1A is a perspective view of a generally rectangular hollow elongated support member capable of utilization in the present invention.
Figure 1B:
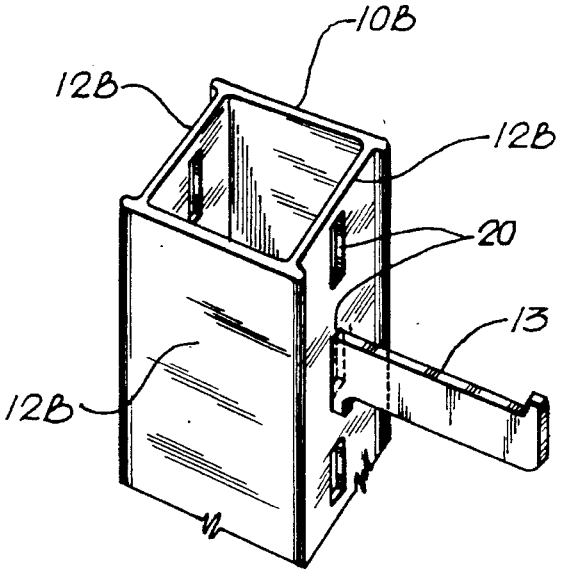
FIG. 1B is a perspective view of a generally square shaped hollow elongated support member.

Referring to FIGS. 1A and 1B, a generally hollow elongated support member 10A or 10B having a series of spaced apertures 20 can be made of a generally rectangular (1A) or square (1B) shape and utilized as the basic support element in the display post assembly. Spaced apertures 20 can be found on each of the two shorter sides 12A of the generally rectangular support member 10A, or on the two opposite sides 12B of the generally square shaped support member 10B, although it is certainly possible to utilize spaced apertures on only one of the two sides. The apertures can be of any shape; however, the preferred shape is in the form of American standardized slots which allow for the insertion of a variety of detachable standardized display devices 13.

Figure 1C:
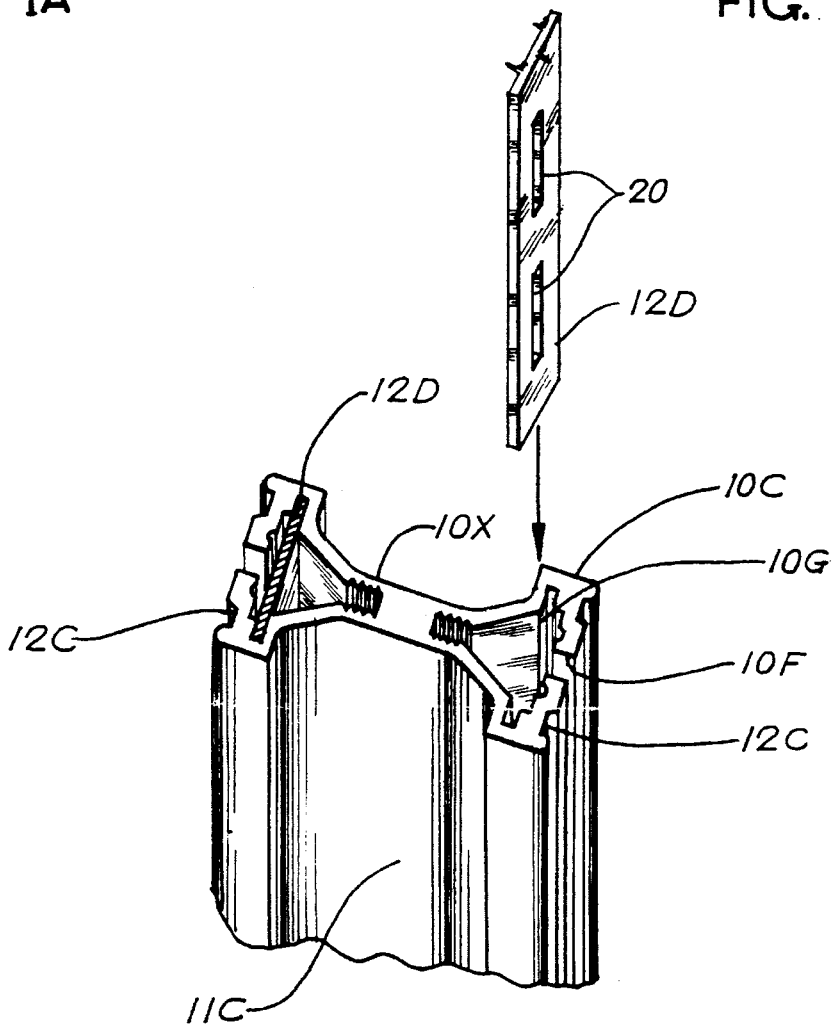
FIG. 1C is a perspective view of an extruded support member having a center brace design.
Figure 1D:
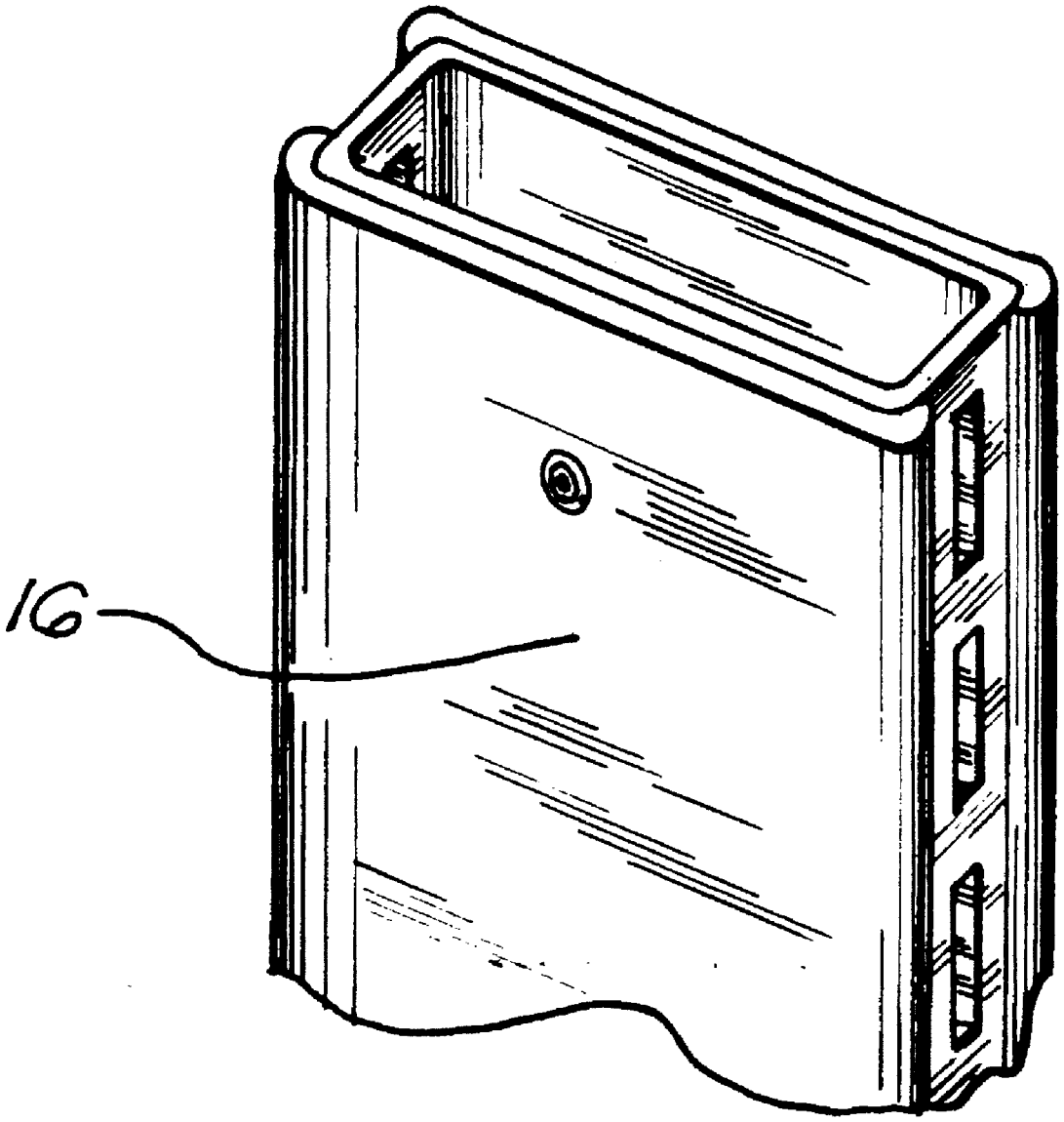
FIG. 1D is a perspective view of a generally rectangular hollow elongated support member having continuous or intermediate attachments as utilized in the present invention.

Referring to FIG. 1C, an extruded support member 10C having a generally x-shaped center brace design 10-X and grooves 10-G running along its length is depicted. Many internal brace designs can be used with an extruded support member consistent with the objectives of the present inventions. Inserts 12D having spaced apertures (heavy duty or regular duty) 20 fit within grooves 10-G, and flanges 10-F provide an unobstructed channel for the insertion of display devices 13 into spaced apertures 20.

Figure 2A:
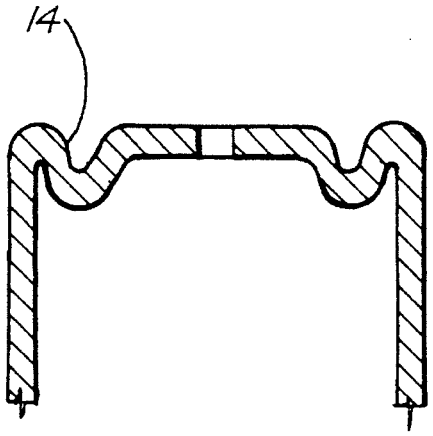
FIG. 2A is an end view of one of the two shorter sides of a generally rectangular hollow elongated support member, having spaced apertures therein.
Figure 2B:
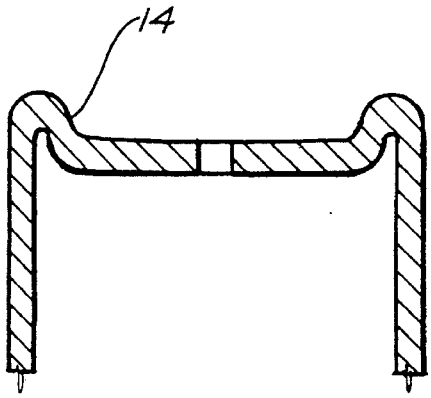
FIG. 2B is an end view of one of the opposite sides of a generally square shaped hollow elongated support member, having spaced apertures therein.
Figure 2C:
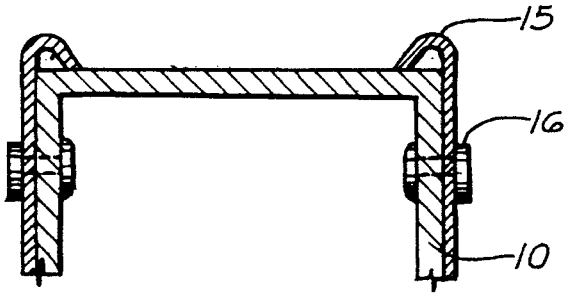
FIG. 2C is an end view of a support member having a means for snapably attaching a post cover joined thereto.
Figure 2D:
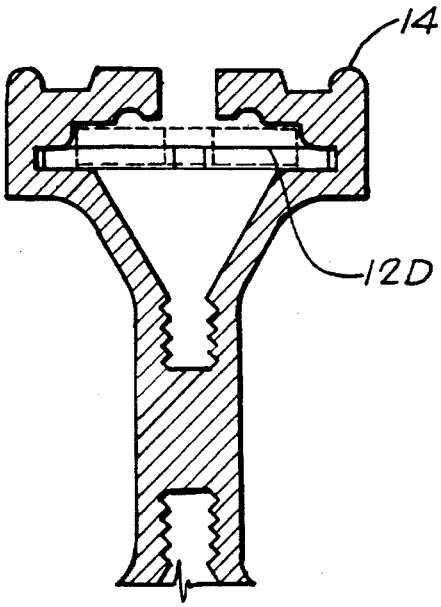
FIG. 2D is an end view of an extruded support member having an insert with heavy duty or regular duty spaced apertures placed in an internal groove running the length of the support member.
Figure 3A:
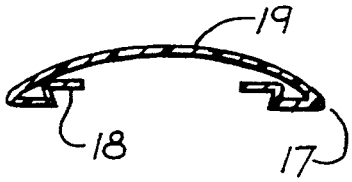
FIG. 3A is an end view of one style of a display post cover of the present invention.
Figure 3B:
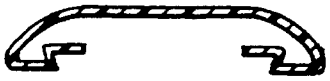
FIGS. 3B–3J are some of the many alternative ornamental designs of the display post cover.
Figure 3C:
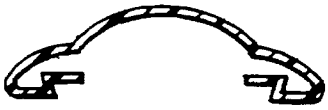
Figure 3D:
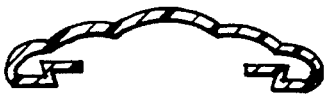
Figure 3E:
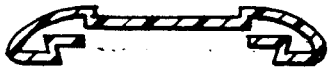
Figure 3F:
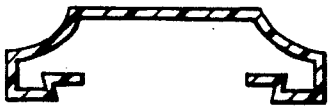
Figure 3G:
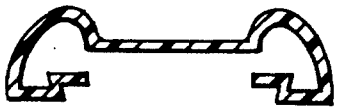
Figure 3H:
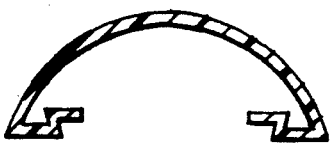
Figure 3I:
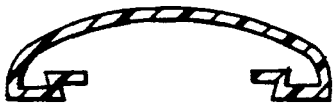
Figure 3J:
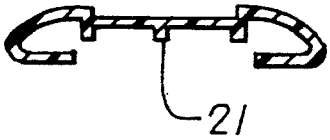
Figure 4A:
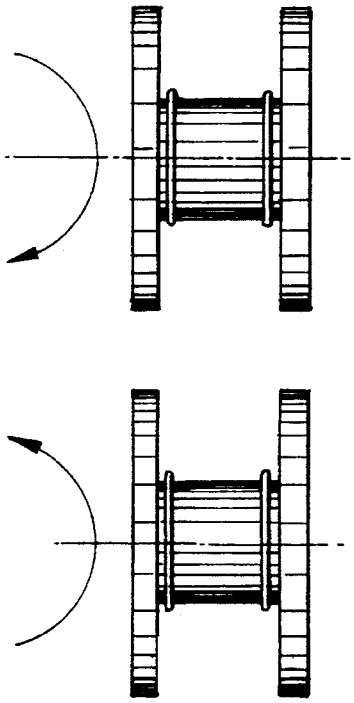
FIG. 4A shows a front view of a set of rolling dies utilized to impress the snap-on edges into the support member.
Figure 4B:
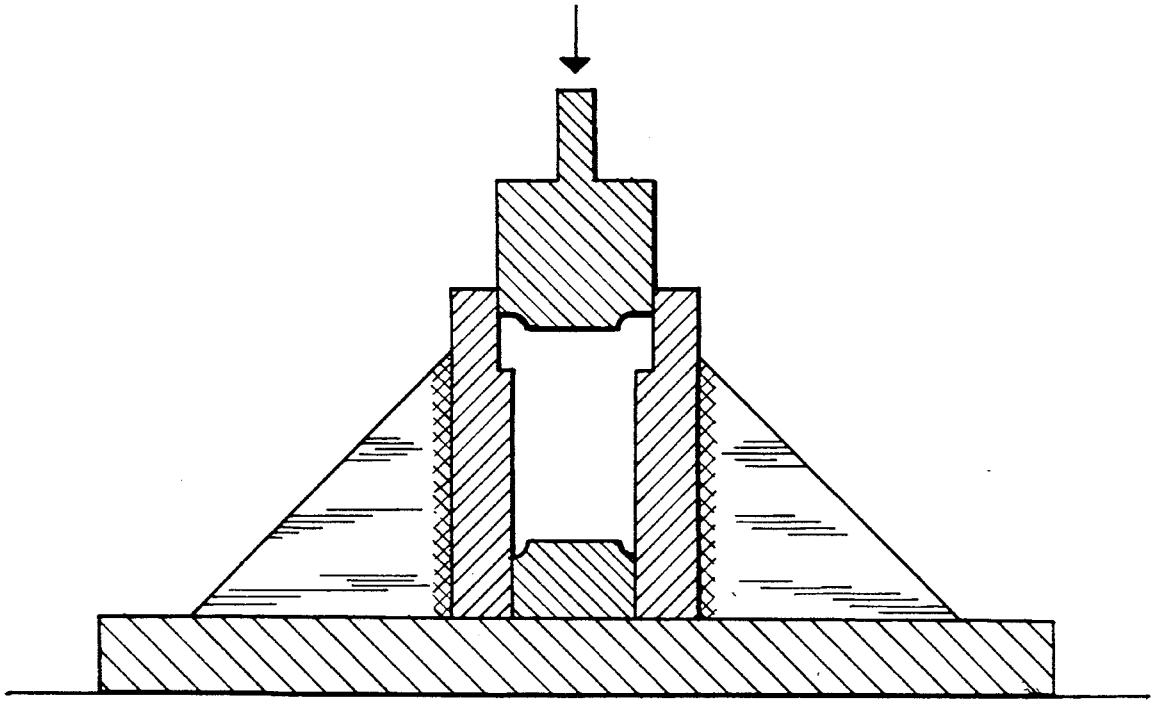
FIG. 4B shows a section view of a break press die.
Figure 5:
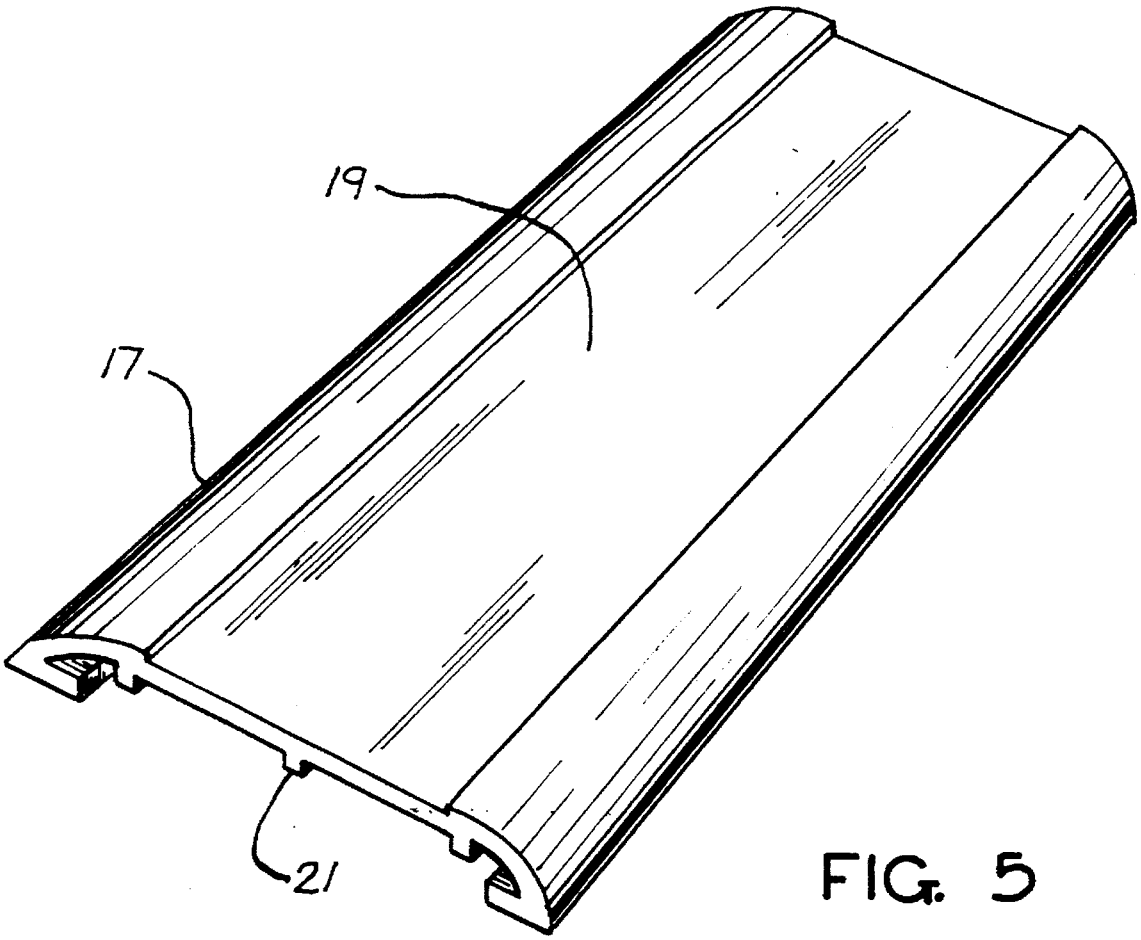
FIG. 5 shows a perspective view of one style of a post cover.
Figure 7A:
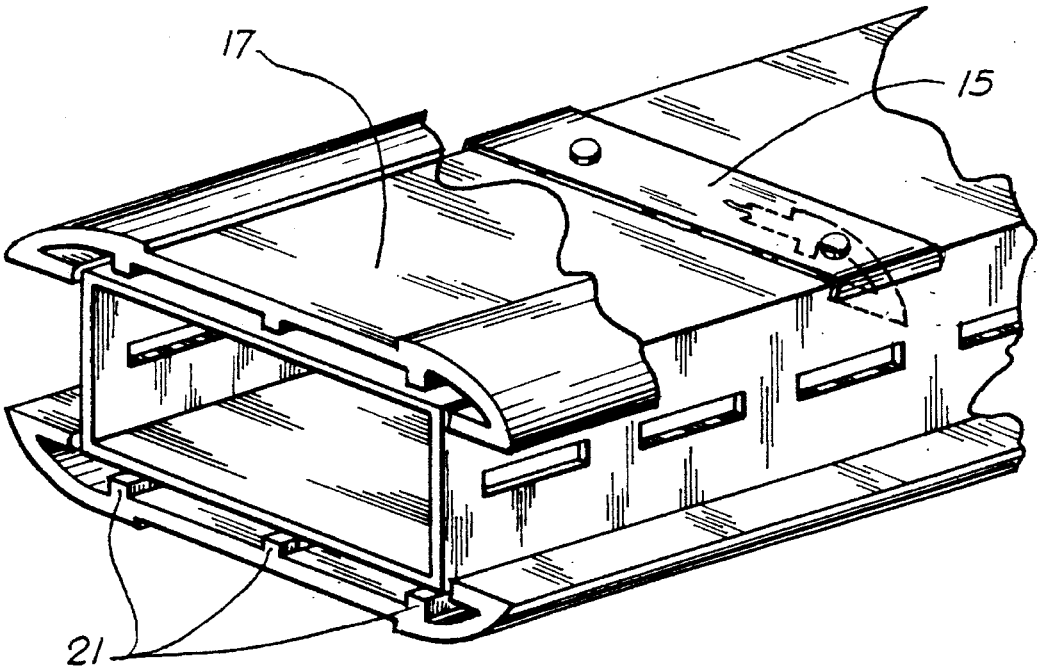
FIG. 7A is a perspective view of a support member having a means for snapably attaching post covers joined to it. 7B is a perspective view of a support member having another means for snapably attaching post covers.
Figure 7B:
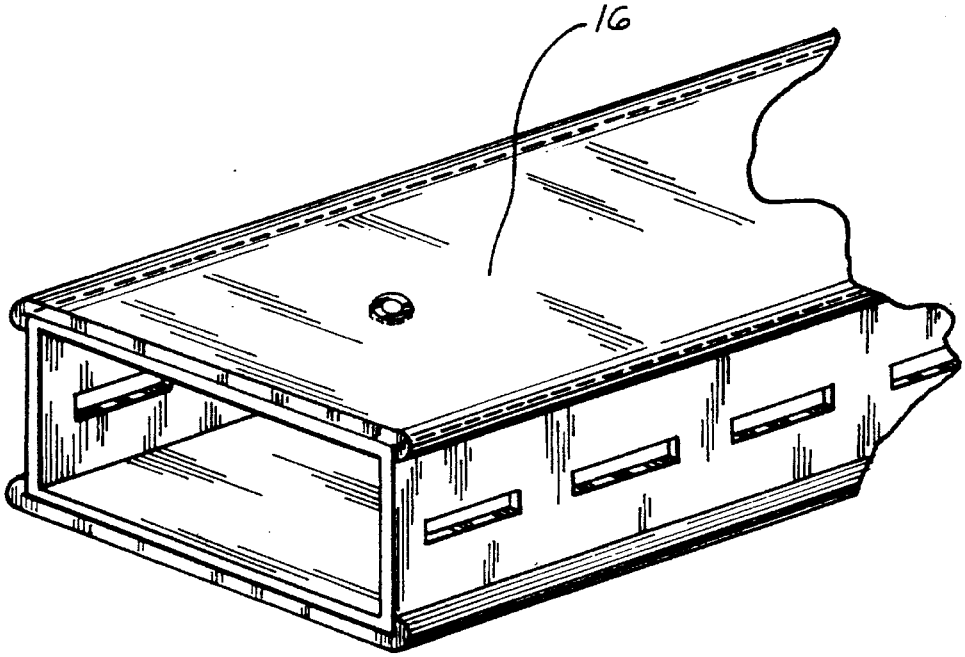

With reference to FIG. 2A and 2B, in a preferred embodiment of the present invention the two shorter sides 12A of the generally rectangular support member 10A or the two opposite sides 12B of the generally square shaped support member 10B have snap-on edges 14 formed along either side of the apertures 20. The snap-on edges provide one means by which the post covers 17, shown in FIGS. 3, attach to the various designs of the generally hollow elongated support member 10. An alternative preferred embodiment is shown in FIG. 2D, whose snap-on edges 14 of an extruded support member 10C are shown. Another alternative preferred embodiment is shown in FIGS. 7A, 7B and 2C, where the support member 10 has no snap-on or raised edges itself, but which has a means for snapably attaching post covers 15 joined to the support member 10 by a conventional screw, rivet or similar means for joining two articles 16. FIG. 7A discloses another view of snapable attachment means 15 by which post cover 17 is joined to a support member that is a separate structure from said snapable attachment means. FIG. 7B shows an alternative embodiment of a means for snapably attaching post covers 15 joined to a support member 10.

Figure 6A:
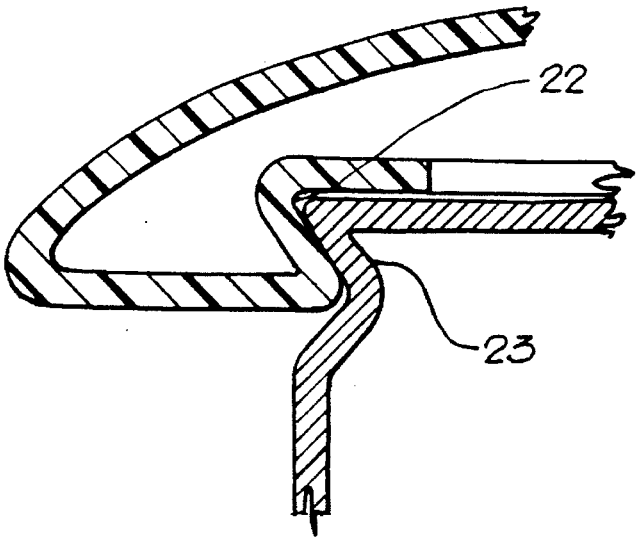
FIG. 6A is a blown-up corner section showing the communication between a post cover and a support member after attachment.
Figure 6:
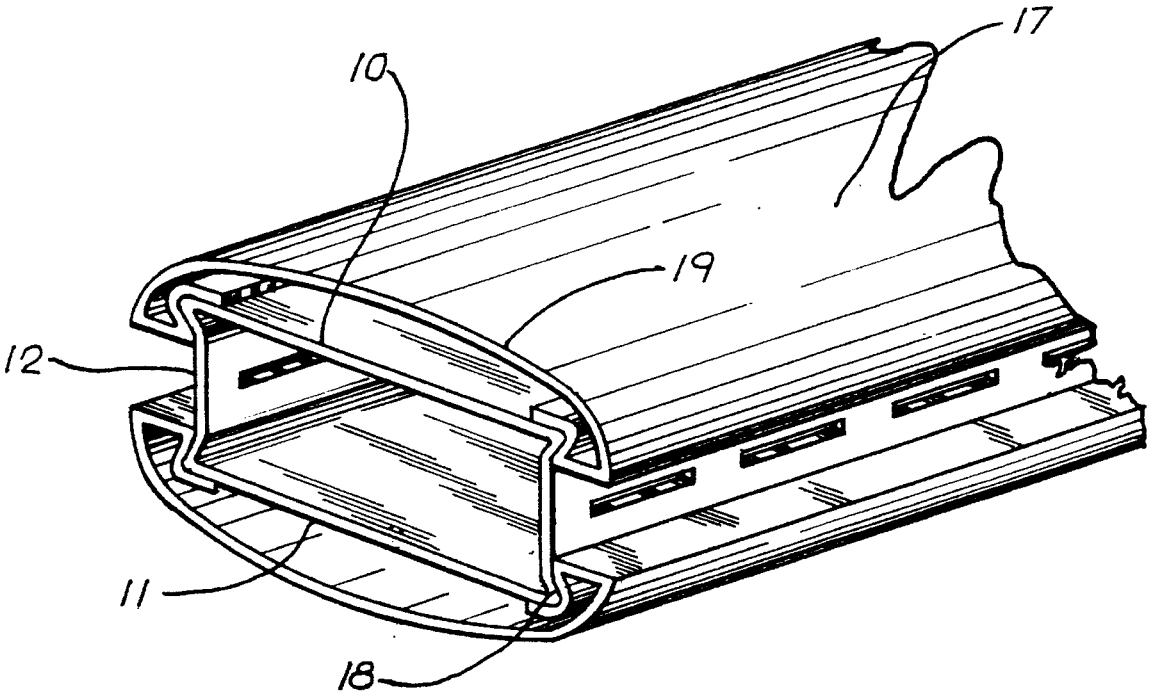
FIG. 6 is a perspective view of a support member having post covers snapably attached thereto.

As shown in FIG. 6, a post cover 17 is designed to cover each of the two longer sides 11A of the generally rectangular support member (as shown in FIG. 1A), and to continue around the support member to snapably attach along the two shorter sides 12A. Each post cover may be made from extruded or molded material, including plastics, aluminum and wood. The materials used for a post cover should have enough rigidity and flexibility to snap onto and off of the support member while generally maintaining its shape. Any desirable color, texture or other appearance can be achieved, depending upon the properties of any of the several materials which can be used to make the post covers. While it is important that the interior edge 18 of the post cover 17 have a shape that permits snapable attachment over the two longer sides 11A and 11C of the generally rectangular support member (FIG. 2A) or the means for snapably attaching post covers (FIG. 2C), it is readily apparent that the exterior surface 19 of the post cover 17 can be a variety of shapes (FIGS. 3A–3J), including but not limited to a rectangular shape, a circular shape, an oval shape, and a triangular shape, as well as combinations thereof. The post cover may have internal support ribs 21 or it may be used without ribs.

A generally rectangular or square shaped hollow elongated support member of the present invention can have two post covers snapably attached thereto, along the two longer sides of the generally rectangular support member or the opposite sides of the generally square shaped support member. Each post cover can extend around the two other sides of the support member containing the spaced apertures to any degree that secures attachment and still permits the insertion of display arms or other connectable members in the spaced apertures. It is preferred that the interior edge 18 of the post covers 17 have at least some generally flat portions that coincide with the longer sides 11 of the support member. Support ribs 21 may be added to the post covers.

Since the post cover of the present invention snaps onto the support member or means for snapably attaching post covers 15, it must be of a material that is capable of bending slightly to attach as shown in FIG. 6A, and yet be resilient enough to snap back into its proper shape once adapting corners 22 of the post cover have mated with the snap-on edges 23 of the support member or once the adapting corners 22 have mated with support members having a means for snapably attaching post covers 15 joined to the support member.

After two post covers are snapped onto the elongated support member, a display arm 13 can still be inserted into the spaced apertures in order to display merchandise.

The snap-on edges are made part of the support member by subjecting the support member to well-known roll forming techniques or press forming techniques.

The standardization of the aperture size and spacing is important in the United States so that the entire display system can utilize standard display arms and other display hardware used in industry. Standard aperture are 1 ⅛ inches long and ⅛ inch wide for heavy duty, and 17/32 inch long and 0.110 inch wide for regular duty apertures. The apertures should be spaced apart by one or two inches between centers (measured along the length of the aperture).

Figure 8:
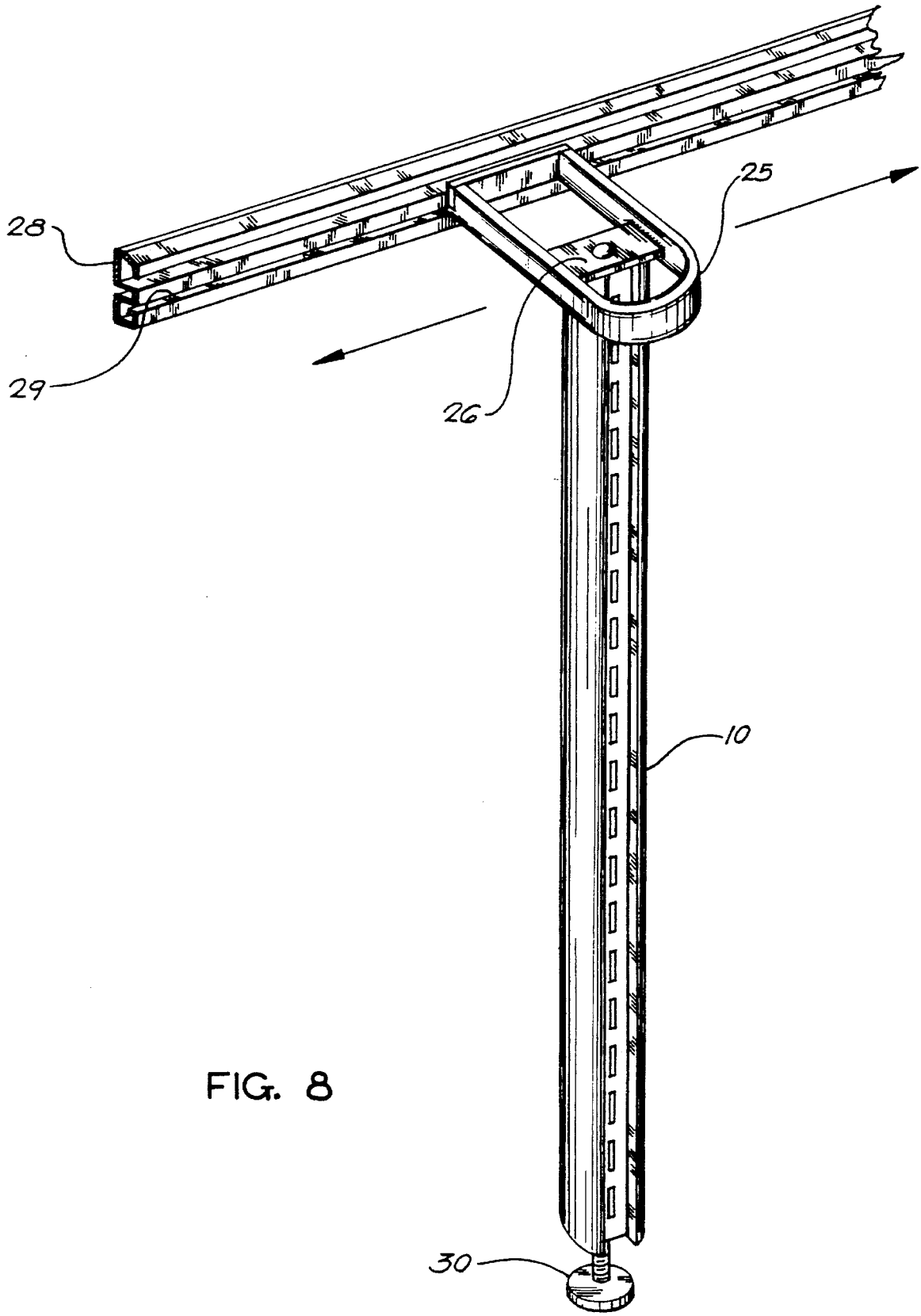
FIG. 8 is a perspective view of a means for slidably attaching a support member to a wall, together with a support member having post covers thereon.
Figure 9A:
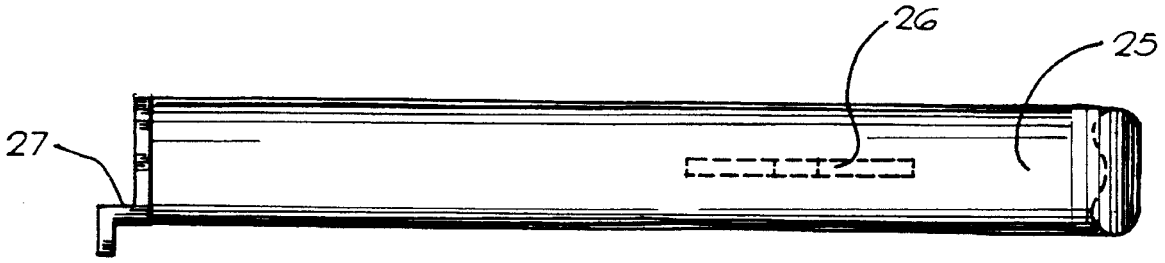
FIG. 9A is a side view of a sliding post mount.
Figure 9B:
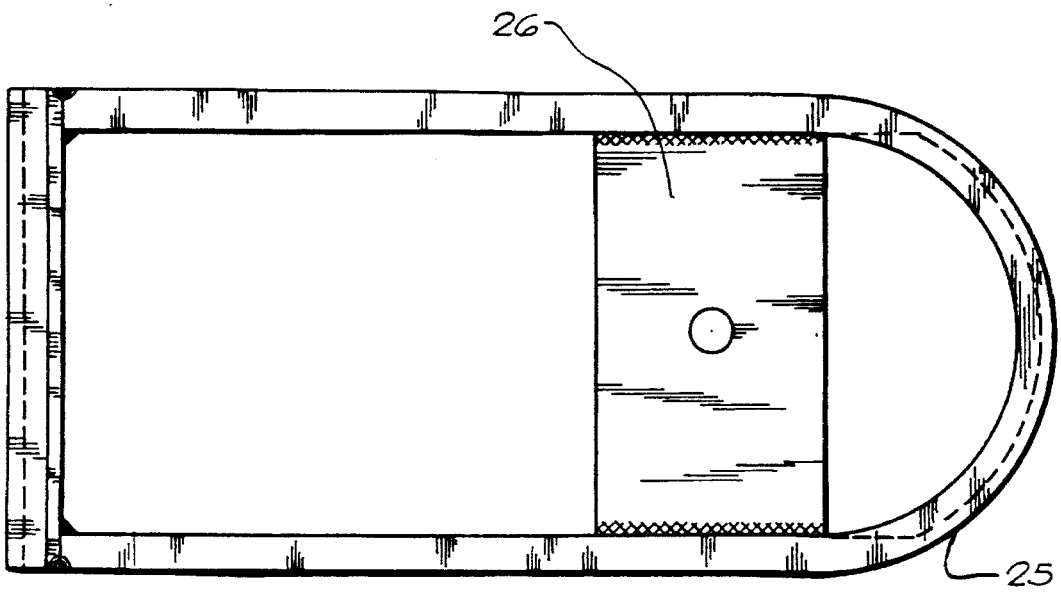
FIG. 9B is a plan view of a sliding post mount.
Figure 10:
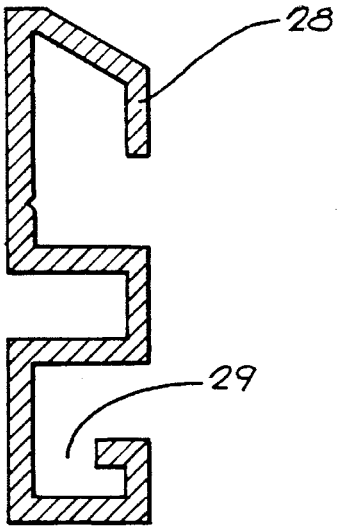
FIG. 10 is a side view of a continuous wall track
Figure 11:
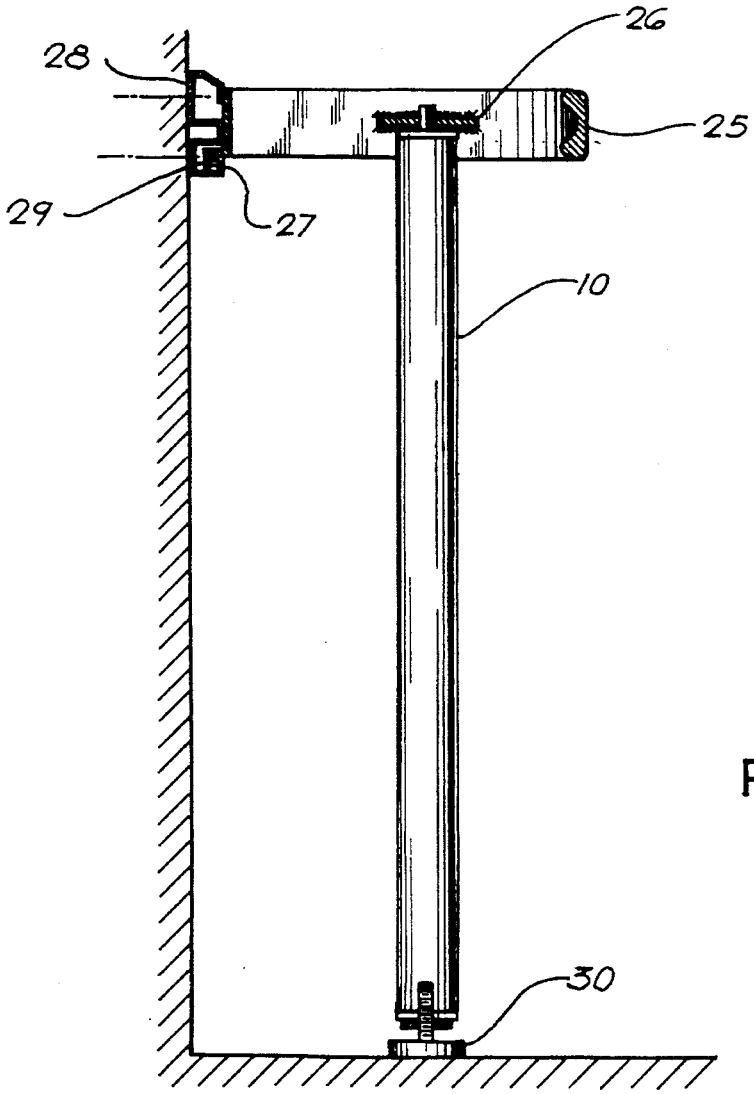
FIG. 11 is a side view showing communication between a sliding post mount and a continuous wall track.

Post mounts 25 having an attachment bar, a recess or some other means for connecting a support member 26 are designed to receive a support member. The post mounts 25 also include a hook 27 or other means for engaging a track. A track 28 can be attached to a wall (FIG. 8), and the hook or other means for engaging a track 27 of a post mount can be placed within a slot or channel 29 of the track to control movement of the post mount, and thereby also control the movement of a support member connected thereto. A support member may include a leveler 30 which can be adjusted to apply pressure on an assembly to secure its position. Likewise, such a leveler can be adjusted to release pressure to permit controlled movement of an assembly.

As is readily apparent, these and many other variations of my inventions are contemplated by the present application and have been disclosed and claimed herein.

What I claim is:

1. A display or support assembly comprising (a) a generally rectangular support member having spaced apertures therein, four generally flat sides, wherein each of said four generally flat sides is generally perpendicular to an adjacent side, and at least two snap-on edges along the length of said support member located proximate the intersection of two separate sets of said generally flat sides, and (b) at least one flexible post cover having a generally flat interior edge portion, and adapting corners adjacent said generally flat interior edge portion for snap-on mating along said snap-on edges of said support member and for snap-off disengagement from said support member, wherein said at least one flexible post cover is secured to said generally rectangular support member along one of said generally flat sides by snap-on mating between said snap-on edges of said support member and said adapting corners of said post cover.

2. The invention of claim 1, wherein said support member is extruded.

3. A display or support assembly comprising (a) a generally rectangular support member having four generally flat sides, wherein each of said four generally flat sides is generally perpendicular to an adjacent side, and at least two snap-on edges along the length of said support member located proximate the intersection of two separate sets of said generally flat sides, and (b) at least one flexible post cover having a generally flat interior edge portion, and adapting corners adjacent said generally flat interior edge portion for snap-on mating along said snap-on edges of said support member and for snap-off disengagement from said support member, wherein said at least one flexible post cover is secured to said generally rectangular support member along one of said generally flat sides by snap-on mating between said snap-on edges of said support member and said adapting corners of said post cover.

* * * * *